US005662408A

United States Patent [19]

Marischen

[11] Patent Number: 5,662,408

[45] Date of Patent: Sep. 2, 1997

[54] SIMPLE PLUG IN NIGHT LIGHT HAVING A LOW PROFILE

[75] Inventor: Joseph E. Marischen, Austin, Tex.

[73] Assignee: Austin Innovations, Inc., Austin, Tex.

[21] Appl. No.: 641,833

[22] Filed: May 2, 1996

Related U.S. Application Data

[63] Continuation of Ser. No. 270,238, Jul. 1, 1994.

[51] Int. Cl.[6] ..... F21V 9/00

[52] U.S. Cl. ..... 362/226; 362/84; 362/253

[58] Field of Search ..... 362/84, 95, 226, 362/253, 367; 439/490, 656, 694, 695; 313/318.01, 318.05, 318.12

[56] References Cited

U.S. PATENT DOCUMENTS

| | | | |
|---|---|---|---|
| 2,809,316 | 10/1957 | Jeges | 362/84 |
| 3,056,897 | 10/1962 | Knochel et al. | 362/367 |
| 3,061,716 | 10/1962 | Benander . | |
| 3,121,817 | 2/1964 | Saviers . | |
| 3,307,030 | 2/1967 | DeFrancisco . | |
| 4,138,620 | 2/1979 | Dickson . | |
| 4,774,641 | 9/1988 | Rice . | |
| 4,864,473 | 9/1989 | Tokarz et al. . | |
| 4,927,376 | 5/1990 | Dickie . | |

OTHER PUBLICATIONS

Dynamic Brilliance Corp. Night Light (2 photos).
Circuitech, Inc. (O.F.N.A.) Night Light (2 photos).
Six Photographs of Sylvania Panelescent Nite–Lite.

*Primary Examiner*—Y My Quach
*Attorney, Agent, or Firm*—Clark, Thomas & Winters, a P.C.

[57] ABSTRACT

The night light has a case with a front side and a rear side. The front side of the case has a portion defining a window. The lamp is secured between the sides and covering the window. The lamp has conductors for connecting to an electrical supply which are in electrical contact with a first and second blade, the blades extending from the rear exterior face of the case for engaging an electrical outlet. The blades are held in a slot through the rear side of the case and by a portion of the blades which engages the interior face of the front side of the case.

11 Claims, 3 Drawing Sheets

SIMPLE PLUG IN NIGHT LIGHT HAVING A LOW PROFILE

This application is a Continuation of application Ser. No. 08/270,238, filed Jul. 1, 1994.

FIELD OF THE INVENTION

This invention relates generally to decorative lights, and more particularly to plug-in decorative lights.

BACKGROUND OF THE INVENTION

It is known to use low-wattage electric lamps and electroluminescent electrodes to provide night lights. For example, U.S. Pat. No. 3,061,716 to Benander describes a plug-in night light which uses an electroluminescent cell as a light source and which serves as an electrical outlet. Also, U.S. Pat. No. 3,307,030 to De Francisco describes an electroluminescent device in the form of an electrical cover plate for installation on an electric outlet wall socket. Also, U.K. Patent Application GB2128313A to Dell, et al., describes a night light with a lamp housing containing low-wattage electric lamps having a frame into which decorative panels can be removably inserted. Since these devices generally use small incandescent lamps or flat electroluminescent panels, they generally have a low profile; however, the required manufacturing techniques may be expensive, such as where an electroluminescent panel is rigidly attached to blades for engaging an electrical outlet, or where an electroluminescent material on a rigid metal substrate is connected to the electrical blades. Other connections may be somewhat simpler, but may limit the ability to achieve a low profile device. Moreover, small incandescent lamps are inherently hot, and therefore require a case that is large or well-ventilated, or require connections and materials which will withstand heat. Thus, there exists a need for a simply constructed, low-profile night light.

SUMMARY OF THE INVENTION

An objective of the invention is to provide an inexpensive night light which is simple to manufacture and has a low profile.

According to the present invention, the foregoing and other objects are attained by providing a night light having a case with a front side and a rear side. The front side of the case has a portion defining a window. A lamp is secured between the faces and covering the window. The lamp has a first and second conductor for connection to an electrical supply. There is a first and second blade in electrical contact with the lamp conductors. A blade has a first portion that extends from the rear side of the case for engaging an electrical outlet. Low profile connections secure the blades in reliable electrical contact with the lamp conductors.

In accordance with another aspect of the invention, the lamp provides enough illumination to allow a person to see obstacles in an otherwise dark room and yet consumes very little power, so that the electrical contact between a lamp conductor and a blade may have a relatively high resistance without overheating.

In accordance with another aspect of the invention, the surface area of the contact between the lamp conductor and the blade is small, and the conductor is mechanically held against a blade portion. A blade is secured to the case first by the first blade portion being held in a slot through the rear side of the case, and second by a second blade portion extending axially from the first blade portion and engaging the interior face of the front side of the case. A third blade portion essentially perpendicular to the first and second blade portions engages the interior face of the rear side of the case. A lamp conductor is held against any portion of a blade within the case. In one embodiment, the conductor is held against the third blade portion by compression between the front and rear sides of the case. A compressible shim may be used to overlay the lamp conductor and third blade portion so that the shim engages the interior face of the front side. Thus, when the front and rear side of the case are secured together, the case compresses the shim against the lamp conductor and blade. Of course, the lamp conductor may be connected to the blade by soldering, cementing or other means.

The invention is thus advantageous in that the electrical connection between a lamp conductor and a blade may have a relatively high electrical resistance without causing the temperature of the connection to rise above ambient temperature. This tolerance for relatively high resistance allows the use of relatively small forces to hold the lamp conductors against the blades, which in turn allows a low profile case having thin sides.

The invention is intended to be limited only as defined in the claims. Additional objects, advantages and novel features are set forth in the following description, or will be apparent to those skilled in the art or those practicing the invention. Other embodiments are within the scope and spirit of the invention, and its details are capable of modifications in various obvious respects, all without departing from the invention. Accordingly, the drawings and description are to be regarded as illustrative in nature, and not as restrictive.

DETAILED DESCRIPTION

Figure 1:
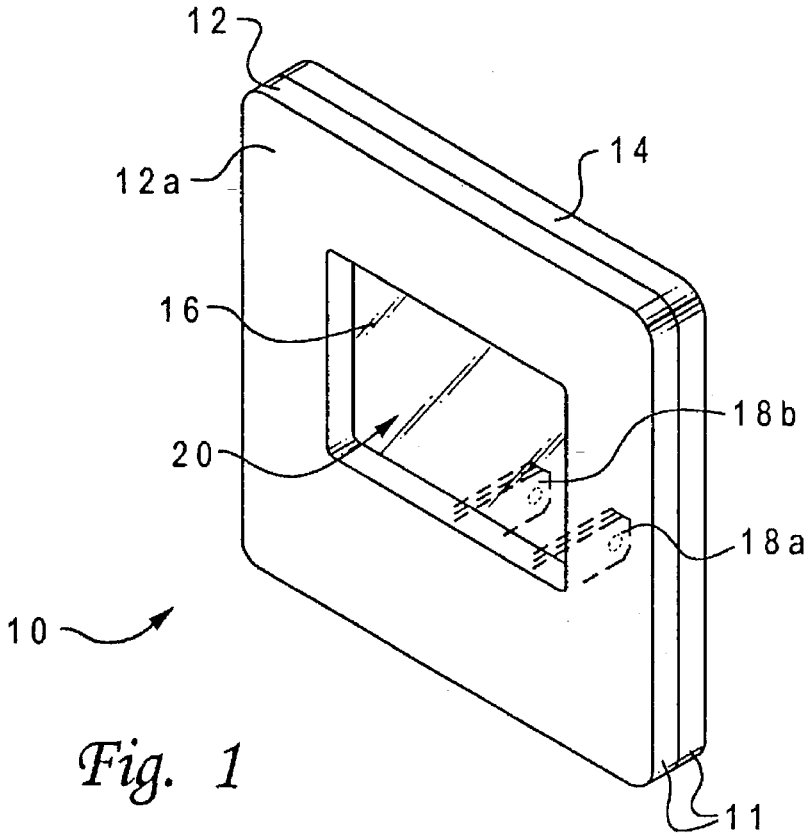
FIG. 1 is a perspective of the night light from a viewpoint in front of and to the side of the device.

FIG. 1 shows night light 10 having a case 11 with a front side 12 and a rear side 14. Front side 12 has a window 16 through which can be seen a lamp 20 covering the window. The exterior face 12*a* of front side 12 is visible in FIG. 1. In the preferred embodiment the sides 12 and 14 have a thickness of only ⅛ inch.

Figure 2:
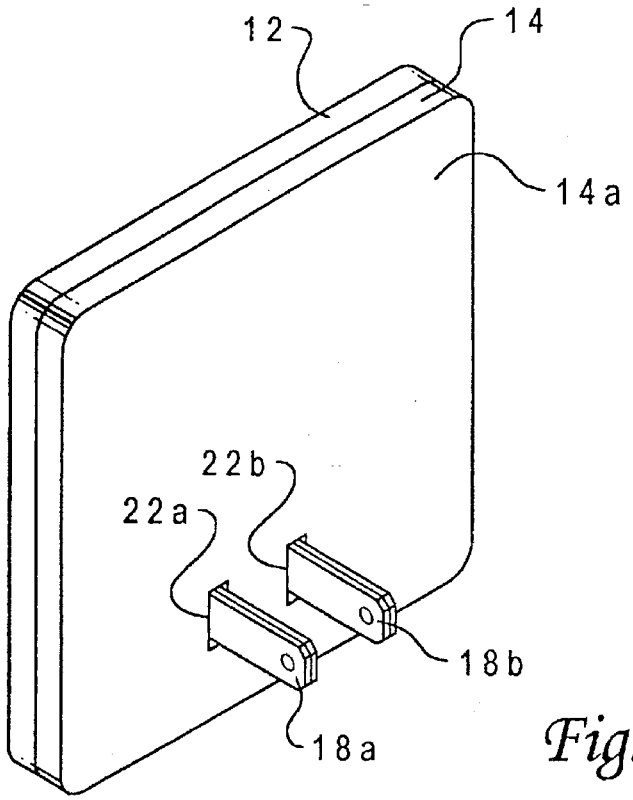
FIG. 2 is a perspective of the night light from a viewpoint behind and to the side of the device.

In FIG. 2 the exterior face 14*a* of the rear side 14 may be seen. Extending from the rear exterior face 14*a* of the case 11 is a first blade 18*a* and a second blade 18*b* for engaging an electrical outlet. The blades 18*a* and 18*b* extend through slots 22*a* and 22*b* in the rear side 14.

Figure 3:
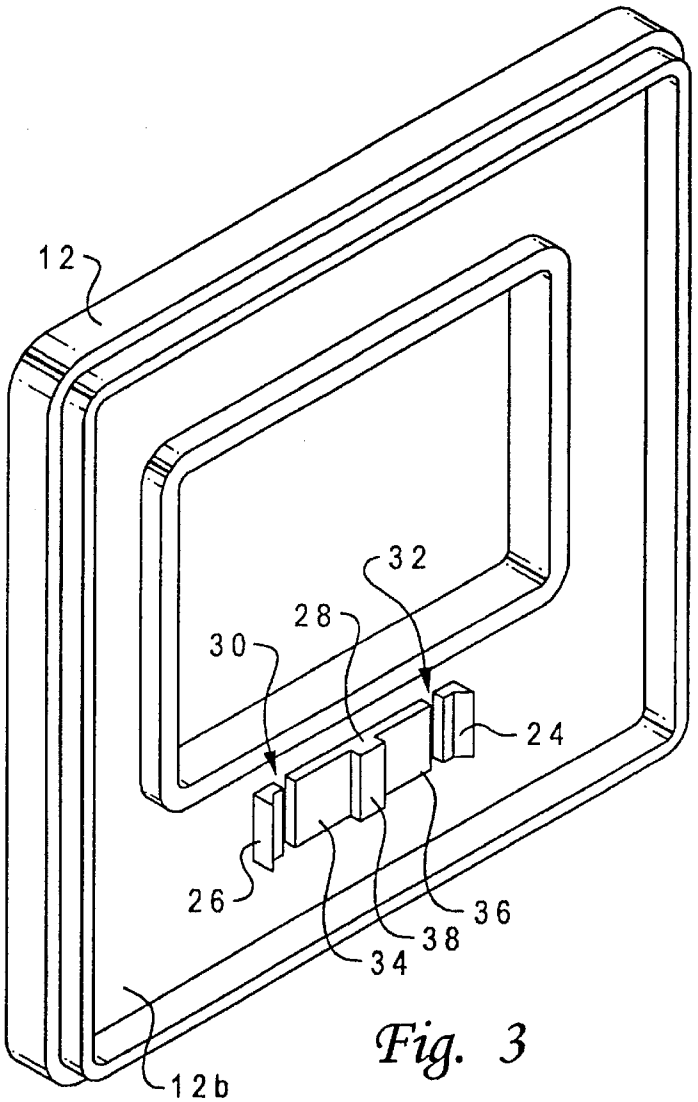
FIG. 3 is a perspective view of the interior face of the front side of the night light.

In FIG. 3 the interior face 12*b* of the front side 12 is seen with protrusions 24, 26, and 28. Protrusions 26 and 28 form a slot 30 therebetween. Likewise, protrusions 24 and 28 form a slot 32. Protrusion 28 has faces 34, 36, and 38.

Figure 4:
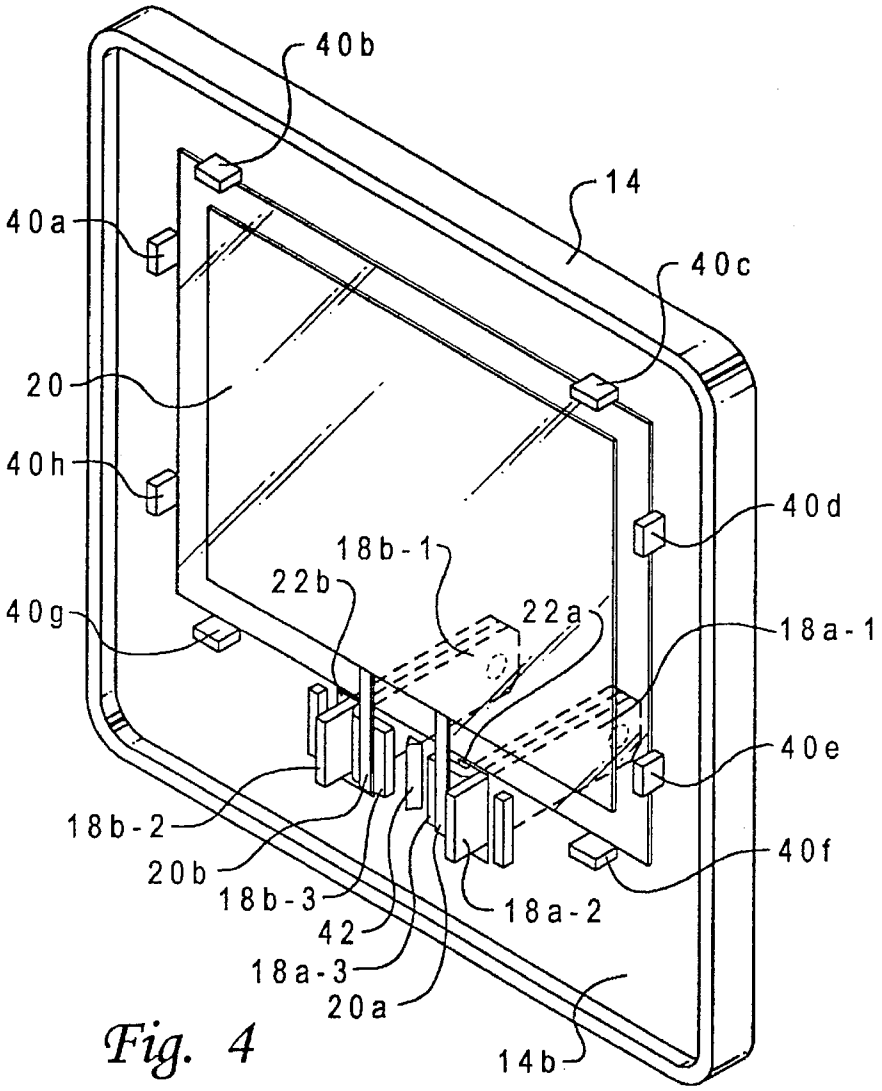
FIG. 4 is a perspective view of the interior face of the rear side of the night light.

In FIG. 4 the interior face 14*b* of rear side 14 is shown with protrusions 40*a*, 40*b*, 40*c*, etc. surrounding lamp 20. From this view it may be seen that blade 18*a* has a first portion 18*a*-1 extending from the rear exterior face 14*a* (not shown), and a second portion 18*a*-2 extending axially from the first blade portion 18*a*-1, and away from the interior face 14*b* of the rear side. Also visible is a third portion 18*a*-3 of the blade 18*a*. The third portion 18*a*-3 engages the interior face 14*b* of the rear side 14 and extends essentially perpendicular to the first portion 18*a*-1 and the second portion 18*a*-2.

Figure 5:
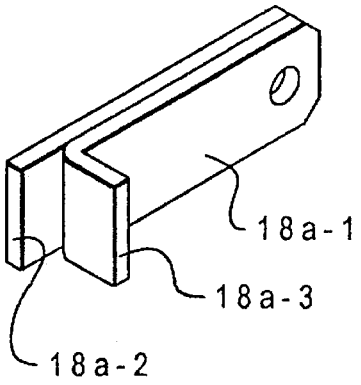
FIG. 5 is a perspective view of a blade.

A complete blade is shown in FIG. 5 removed from the case 11, wherein the three blade portions 18*a*-1, 18*a*-2, and 18*a*-3 may be more clearly seen.

Also, the second blade 18*b* has portions 18*b*-2 and 18*b*-3 which are visible in FIG. 4. A protrusion 42 extending from the interior face 14*b* separates blade portions 18*a*-3 and 18*b*-3. Lamp 20 has conductors 20*a* and 20*b* positioned against blade portions 18*a*-3 and 18*b*-3 respectively. The blades 18*a* and 18*b* are positioned through slots 22*a* and 22*b* in the rear side 14. Slots 22*a* and 22*b* are located such that when the front side 12 (FIG. 3) and the back side 14 are placed together, the blade portions 18*a*-3 and 18*b*-3 are opposite faces 34 and 36 (FIG. 3) of protrusion 28 (FIG. 3). Also, blade portions 18*a*-2 and 18*b*-2 are positioned opposite slots 30 and 32 (FIG. 3). Thus, when the front side 12 and rear side 14 are joined, blade portions 18*a*-3 and 18*b*-3 engage the interior faces 12*b* of the front side 12 against faces 34 and 36, and blade portions 18*a*-2 and 18*b*-2 engage the interior face 12*b* within slots 30 and 32 so that the blades are held securely in place and the lamp conductors 20*a* and 20*b* are pressed securely against blade portions 18*a*-3 and 18*b*-3 thereby establishing an electrical connection between the lamp and the blades.

Figure 6:
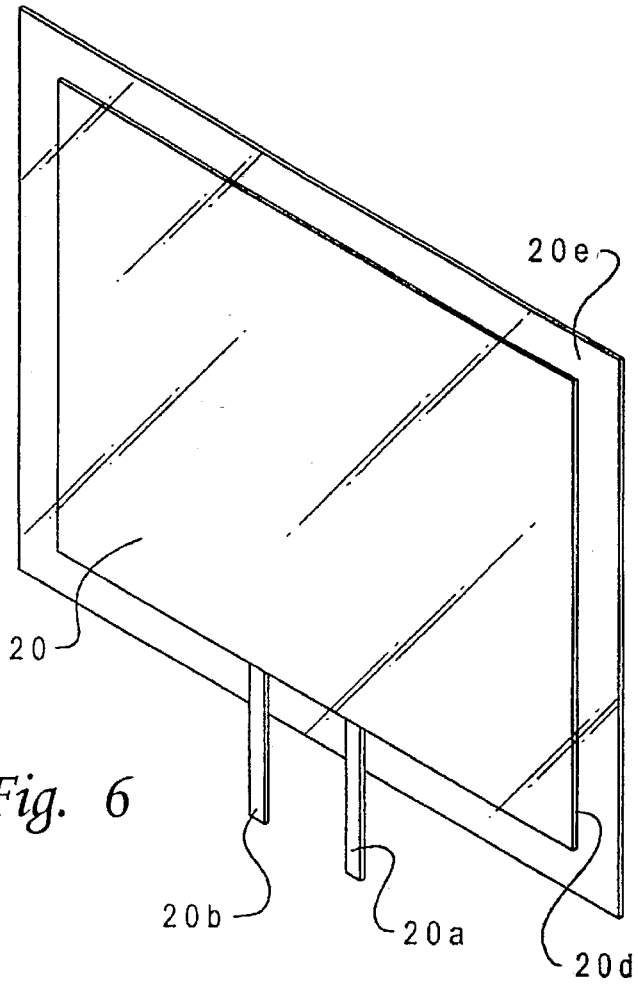
FIG. 6 is a perspective view of an electroluminescent lamp used in the night light.

Turning to FIG. 6, the lamp 20 is shown. In the preferred embodiment the lamp has an electroluminescent panel 20*d* which provides the source of illumination. The panel 20*d* is covered by a thin, transparent protective material 20*e*. Since the lamp conductors 20*a* and 20*b* extend away from the electroluminescent panel 20*d* the electrical connection to the blades is not on the panel itself. Thus the electroluminescent panel 20*d* is not part of the mechanical structure for securing the electrical connection to the blades for engaging the electrical outlet and a thin, flexible, lightweight substrate may be used for the panel 20*d*. For example, the lamp may have an overall thickness (including the substrate, electroluminescent material, and cover) of only 0.04 inch. In the preferred embodiment, the lamp provides initial illumination of at least 4 lumens but is rated at only 0.03 watts at 115 VAC. Of course the thickness of the lamp, amount of illumination and power consumption may be modified to achieve other obvious combinations within the described objectives and advantages of the present invention.

Figure 7:
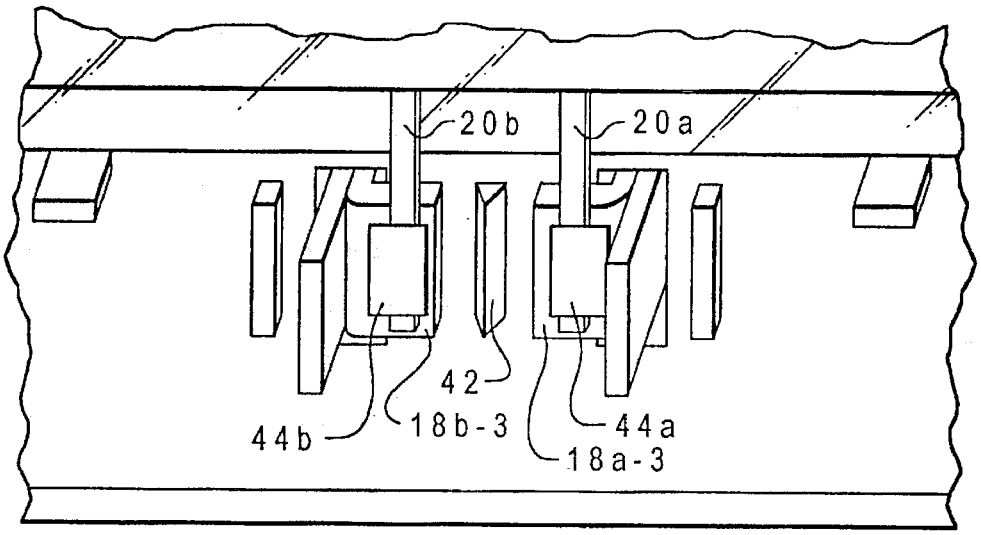
FIG. 7 is a detailed view of an electrical connector between the lamp and the blades for engaging an electrical outlet.

FIG. 7 shows details of the electrical connection between the lamp conductors and the blades for engaging an electrical outlet. In the preferred embodiment of the present invention, a compressible shim 44*a* overlays lamp conductor 20*a* and blade portion 18*a*-3, and another compressible shim 44*b* overlays lamp conductor 20*b* and blade portion 18*b*-3. The shims 44*a* and 44*b* thus engage the interior face 12*b* and, when the front side 12 (FIG. 3) and rear side 14 (FIG. 4) of the case are joined, the case compresses the shims 44*a* and 44*b* against the blade portions 18*a*-3 and 18*b*-3 and conductors 20*a* and 20*b* to securely hold the conductors 20*a* and 20*b* against the blades 18*a* and 18*b*. In the preferred embodiment the surface area of the contact between a lamp conductor and a blade is only 0.02 square inch or less, however this area may be varied as required within the context of the invention.

What is claimed is:

1. A night light, comprising:

a case having a front side and a rear side, the front and rear sides each having an interior and exterior face, and the front side of the case having a portion defining a window;

a lamp covering the window and secured between the interior faces of the front and rear sides of the case, the lamp having a first and second conductor for connection to an electrical supply;

a first and second blade in electrical contact with the lamp conductors, at least one of the first and second blades having a first portion that extends from the rear exterior face of the case for engaging an electrical outlet; and wherein said at least one of the first and second blades is secured to the case first by the first blade portion being held in a slot through the rear side of the case, and second by a second blade portion extending from the first blade portion and engaging the interior face of the front side of the case, and third by a third blade portion essentially perpendicular to the first and second blade portions, the third blade portion engaging the interior face of the rear side of the case and being compressed between the front and rear sides of the case.

2. The night light of claim 1, wherein at least one of the first and second conductors is held in electrical contact with said third blade portion by compression between said third blade portion and the case.

3. The night light of claim 2, wherein the lamp is an electroluminescent panel.

4. The night light of claim 3, wherein the second blade is configured and shaped identically and positioned symmetrically to the first blade.

5. A night light, comprising:

a case having a front side and a rear side, the front and rear sides each having an interior and exterior face, and the front side of the case having a portion defining a window;

a lamp covering the window and secured between the interior faces of the front and rear sides of the case, the lamp having an electroluminescent panel and a first and second conductor which extend away from the panel for connection to an electrical supply;

a first and second blade for engaging an electrical outlet, the first blade and the first conductor being in contact remote from the electroluminescent panel, and the first blade having a first blade portion that extends from the rear exterior face of the case for engaging to the electrical outlet; and wherein the first blade further comprises a second blade portion, and the first blade is secured to the case by the first blade portion being held in a slot through the rear side of the case, and by the second blade portion being clamped by the front and rear sides of the case.

6. The night light of claim 5, wherein the first blade further comprises a third blade portion, the third blade portion also being clamped by the front and rear sides of the case.

7. The night light of claim 5, wherein the contact between the first conductor and the first blade is secured at least in part by the second blade portion being clamped against the first conductor by the front and rear sides of the case.

8. The night light of claim 7, wherein the contact between the first conductor and the first blade is further secured by the second blade portion being attached to the first conductor.

9. The night light of claim 5 further comprising a shim between one of the sides and the second blade portion, the shim also being clamped by the front and rear sides of the case.

10. A method of making a night light, comprising the steps of:

providing a case having a front side and a rear side, the front and rear sides each having an interior and exterior face, the front side having a portion defining a window, and the rear side having at least one slot;

providing a lamp having a luminescent panel and a first and second conductor extending away from the panel for connection to an electrical supply;

providing a first and second blade for engaging an electrical outlet;

securing the lamp between the interior faces of the case and exposing it through the window;

securing the first blade by the steps of:

inserting the first blade through the slot in the rear side of the case; and clamping the first blade by the front and rear sides of the case; and securing the first conductor and the first blade in electrical contact remote from the luminescent panel.

11. The method of claim 10, wherein the step of clamping the blade by the front and rear sides of the case further comprises the step of engaging the blade with the interior faces of the sides of the case.

* * * * *